US012163201B2

(12) United States Patent
Alibeigi

(10) Patent No.: US 12,163,201 B2
(45) Date of Patent: Dec. 10, 2024

(54) COLD ROLLED AND COATED STEEL SHEET AND A METHOD OF MANUFACTURING THEREOF

(71) Applicant: ArcelorMittal, Luxembourg (LU)

(72) Inventor: Samaneh Alibeigi, Metz (FR)

(73) Assignee: ArcelorMittal, Luxembourg (LU)

( * ) Notice: Subject to any disclaimer, the term of this patent is extended or adjusted under 35 U.S.C. 154(b) by 231 days.

(21) Appl. No.: 16/769,954

(22) PCT Filed: Oct. 22, 2018

(86) PCT No.: PCT/IB2018/058188
§ 371 (c)(1),
(2) Date: Jun. 4, 2020

(87) PCT Pub. No.: WO2019/123034
PCT Pub. Date: Jun. 27, 2019

(65) Prior Publication Data

US 2020/0392596 A1 Dec. 17, 2020

(30) Foreign Application Priority Data

Dec. 19, 2017 (WO) ..... PCT/IB2017/058131

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 9/46* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 9/46; C21D 6/005; C21D 6/008; C21D 8/0205; C21D 8/0226; C21D 8/0236; C21D 8/0263; C21D 2211/001; C21D 2211/002; C21D 2211/005; C21D 2211/008; C22C 38/02; C22C 38/04; C22C 38/06
See application file for complete search history.

(56) References Cited

U.S. PATENT DOCUMENTS

| | | | | |
|---|---|---|---|---|
| 8,657,969 | B2 | 2/2014 | Kawasaki et al. | |
| 2010/0104891 | A1 | 4/2010 | Nakagaito | |
| 2014/0087208 | A1 | 3/2014 | Toda et al. | |
| 2014/0170439 | A1 | 6/2014 | Allain et al. | |
| 2014/0234657 | A1* | 8/2014 | Azuma | C22C 38/002 148/522 |
| 2014/0234659 | A1 | 8/2014 | Kawata et al. | |
| 2015/0225830 | A1* | 8/2015 | Nonaka | C21D 8/0473 148/333 |
| 2017/0145537 | A1 | 5/2017 | Xu et al. | |
| 2017/0159143 | A1 | 6/2017 | Föjer et al. | |
| 2018/0202016 | A1 | 7/2018 | Yokoyama et al. | |
| 2019/0003009 | A1* | 1/2019 | Kawata | C22C 38/04 |
| 2019/0032186 | A1 | 1/2019 | Ueno et al. | |

FOREIGN PATENT DOCUMENTS

| | | | |
|---|---|---|---|
| CN | 101641456 | A | 2/2010 |
| CN | 103620063 | A | 3/2014 |
| CN | 106574349 | A | 4/2017 |
| CN | 106661650 | A | 5/2017 |
| EP | 2 402470 | A1 | 1/2012 |
| EP | 2524972 | A1 | 11/2012 |
| JP | 2005325393 | A | 11/2005 |
| JP | 2008214645 | A | 9/2008 |
| JP | 2014047395 | A | 3/2014 |
| JP | 2016089235 | A | 5/2016 |
| JP | 2016141816 | A | 8/2016 |
| JP | 2016216808 | A | 12/2016 |
| KR | 2014-0052070 | | 5/2014 |
| KR | 20140068122 | A | 6/2014 |
| KR | 20150029731 | A | 3/2015 |
| WO | WO 2007/067014 | A1 | 6/2007 |
| WO | WO2017002883 | A1 | 1/2017 |
| WO | WO2017126678 | A1 | 7/2017 |

* cited by examiner

OTHER PUBLICATIONS

International Search Report of PCT/IB2018/059159, Nov. 1, 2019.

*Primary Examiner* — Nicholas A Wang
*Assistant Examiner* — Maxwell Xavier Duffy
(74) *Attorney, Agent, or Firm* — Davidson Kappel LLC

(57) ABSTRACT

A cold rolled and heat treated steel sheet having a composition including elements, expressed in percentage by weight 0.11%≤Carbon≤0.15%, 1.1%≤Manganese≤1.8%, 0.5%≤Silicon≤0.9%, 0.002%≤Phosphorus≤0.02%, 0%≤Sulfur≤0.003%, 0%≤Aluminum≤0.05%, 0%≤Nitrogen≤0.007%, and can contain one or more of optional elements 0.05%≤Chromium≤1%, 0.001%≤Molybdenum≤0.5%, 0.001%≤Niobium≤0.1%, 0.001%≤Titanium≤0.1%, 0.01%≤Copper≤2%, 0.01%≤Nickel≤3%, 0.0001%≤Calcium≤0.005%, 0%≤Vanadium≤0.1%, 0%≤Boron≤0.003%, 0%≤Cerium≤0.1%, 0%≤Magnesium≤0.010%, 0%≤Zirconium≤0.010% the remainder being composed of iron and unavoidable impurities, the microstructure of said steel sheet comprising, 50 to 80% Ferrite, 10 to 30% Bainite, 1 to 10% Residual Austenite, and 1% to 5% Martensite, wherein the cumulated amounts of Bainite and Residual Austenite is more than or equal to 25%.

16 Claims, No Drawings

COLD ROLLED AND COATED STEEL SHEET AND A METHOD OF MANUFACTURING THEREOF

The present invention relates to cold rolled heat and treated steel sheets suitable for use as steel sheet for automobiles.

BACKGROUND

Automotive parts are required to satisfy two inconsistent necessities, namely ease of forming and strength, but in recent years a third requirement of improvement in fuel consumption is also bestowed upon automobiles in view of global environment concerns. Thus, now automotive parts must be made of material having high formability in order that to fit in the criteria of ease of fit in the intricate automobile assembly and at same time have to improve strength for vehicle crashworthiness and durability while reducing weight of vehicle to improve fuel efficiency.

Therefore, intense research and development endeavors are undertaken to reduce the amount of material utilized in car by increasing the strength of material. Conversely, an increase in strength of steel sheets decreases formability, and thus development of materials having both high strength and high formability is necessitated.

Earlier research and developments in the field of high strength and high formability steel sheets have resulted in several methods for producing high strength and high formability steel sheets, some of which are enumerated herein for conclusive appreciation of the present invention:

US20140234657 is a patent application publication that claims a hot-dip galvanized steel sheet having a microstructure, by volume fraction, equal to or more than 20% and equal to or less than 99% in total of one or two of martensite and bainite, a residual structure contains one or two of ferrite, residual austenite of less than 8% by volume fraction, and pearlite of equal to or less than 10% by volume fraction. Further US20140234657 reaches to a tensile strength of 980 MPa but is unable to reach elongation of 25%.

U.S. Pat. No. 8,657,969 claims a high strength galvanized steel sheet that has a tensile strength of 590 MPa or more and excellent processability. The component composition contains, by mass %, C: 0.05% to 0.3%, Si: 0.7% to 2.7%, Mn: 0.5% to 2.8%, P: 0.1% or lower, S: 0.01% or lower, Al: 0.1% or lower, and N: 0.008% or lower, and the balance: Fe or inevitable impurities. The microstructure contains, in terms of area ratio, ferrite phases: 30% to 90%, bainite phases: 3% to 30%, and martensite phases: 5% to 40%, in which, among the martensite phases, martensite phases having an aspect ratio of 3 or more are present in a proportion of 30% or more.

SUMMARY OF THE INVENTION

An object of the present invention is to provide cold-rolled steel sheets that simultaneously have:

- an ultimate tensile strength greater than or equal to 630 MPa and preferably above 650 MPa,
- a total elongation greater than or equal to 26% and preferably above 28%.

The present invention provides cold rolled and heat treated steel sheet having a composition comprising of the following elements, expressed in percentage by weight:

0.11%≤Carbon≤0.15%

1.1%≤Manganese≤1.8%

0.5%≤Silicon≤0.9%

0.002%≤Phosphorus≤0.02%

0%≤Sulfur≤0.003%.

0%≤Aluminum≤0.05%

0%≤Nitrogen≤0.007% and can contain one or more of the following optional elements 0.05%≤Chromium≤1%

0.001%≤Molybdenum≤0.5%

0.001%≤Niobium≤0.1%

0.001%≤Titanium≤0.1%

0.01%≤Copper≤2%

0.01%≤Nickel≤3%

0.0001%≤Calcium≤0.005%

0%≤Vanadium≤0.1%

0%≤Boron≤0.003%

0%≤Cerium≤0.1%

0%≤Magnesium≤0.010%

0%≤Zirconium≤0.010% the remainder composition being composed of iron and unavoidable impurities caused by processing, the microstructure of said steel sheet comprising in area fraction, 50 to 80% Ferrite, 10 to 30% Bainite, 1 to 10% Residual Austenite, and 1% to 5% Martensite, wherein the cumulated amounts of Bainite and Ferrite less than 94%.

In a preferred embodiment, the steel sheets according to the invention may also present a yield strength 320 MPa or more In a preferred embodiment, the steel sheets according to the invention may also present a yield strength to tensile strength ratio of 0.5 or more Preferably, such steel can also have a good suitability for forming, in particular for rolling with good weldability and coatability.

Another object of the present invention is also to make available a method for the manufacturing of these sheets that is compatible with conventional industrial applications while being robust towards manufacturing parameters shifts.

The cold rolled and heat treated steel sheet of the present invention may optionally be coated with zinc or zinc alloys, or with aluminum or aluminum alloys to improve its corrosion resistance.

DETAILED DESCRIPTION

Carbon is present in the steel between 0.11% and 0.15%. Carbon is an element necessary for increasing the strength of the steel sheet by producing low-temperature transformation phases such as bainite, further Carbon also plays a pivotal role in Austenite stabilization hence a necessary element for securing Residual Austenite. Therefore, Carbon plays two pivotal roles one in increasing the strength and another in retaining austenite to impart ductility. But Carbon content less than 0.11% will not be able to stabilize Austenite in an adequate amount required by the steel of the present invention. On the other hand, at a Carbon content exceeding 0.15%, the steel exhibits poor spot weldability which limits its application for the automotive parts.

Manganese content of the steel of the present invention is between 1.1% and 1.8%. This element is gammagenous. The purpose of adding Manganese is essentially to obtain a structure that contains Austenite and impart strength to the steel. An amount of at least 1.1% by weight of Manganese has been found in order to provide the strength and hardenability of the steel sheet as well as to stabilize Austenite. But when Manganese content is more than 1.8% it produces adverse effects such as it retards transformation of Austenite to Bainite during the over-aging holding for Bainite transformation. In addition the Manganese content of above 1.8% also reduces the ductility and also deteriorates the weldability of the present steel hence the elongation targets may not be achieved. A preferable content for the present invention may be kept between 1.2% and 1.8%, further more preferably 1.3% and 1.7%.

Silicon content of the steel of the present invention is between 0.5% and 0.9%. Silicon is a constituent that can retard the precipitation of carbides during overageing, therefore, due to the presence of Silicon, carbon rich Austenite is stabilized at room temperature. Further, due to poor solubility of Silicon in carbide it effectively inhibits or retards the formation of carbides, hence also promotes the formation of Bainitic structure which is sought as per the present invention to impart steel with its essential features. However, disproportionate content of Silicon does not produce the mentioned effect and leads to a problem such as temper embrittlement. Therefore, the concentration is controlled within an upper limit of 0.9%. A preferable content for the present invention may be kept between 0.6% and 0.8%

Phosphorus constituent of the steel of the present invention is between 0.002% and 0.02%. Phosphorus reduces the spot weldability and the hot ductility, particularly due to its tendency to segregate at the grain boundaries or co-segregate with manganese. For these reasons, its content is limited to 0.02% and preferably lower than 0.014%.

Sulfur is not an essential element but may be contained as an impurity in steel and from point of view of the present invention the Sulfur content is preferably as low as possible, but is 0.003% or less from the viewpoint of manufacturing cost. Further if higher Sulfur is present in steel it combines to form Sulfides especially with Manganese and reduces its beneficial impact on the steel of the present invention.

Aluminum is not an essential element but may be contained as a processing impurity in steel due to the fact that aluminum is added in the molten state of the steel to clean steel of the present invention by removing oxygen existing in molten steel to prevent oxygen from forming a gas phase hence may be present up to 0.05% as a residual element. But from point of view of the present invention the Aluminum content is preferably as low as possible.

Nitrogen is limited to 0.007% in order to avoid ageing of material and to minimize the precipitation of nitrides during solidification which are detrimental for mechanical properties of the Steel.

Chromium is an optional element for the present invention. Chromium content may be present in the steel of the present invention is between 0.05% and 1%. Chromium is an essential element that provides strength and hardening to the steel but when used above 1% it impairs surface finish of steel. Further Chromium contents under 1% coarsen the dispersion pattern of carbide in Bainitic structures, hence; keep the density of carbides low in Bainite.

Nickel may be added as an optional element in an amount of 0.01 to 3% to increase the strength of the steel and to improve its toughness. A minimum of 0.01% is required to produce such effects. However, when its content is above 3%, Nickel causes ductility deterioration.

Niobium is an optional element for the present invention. Niobium content may be present in the steel of the present invention between 0.001 and 0.1% and is added in the Steel of the present invention for forming carbo-nitrides to impart strength of the Steel of the present invention by precipitation hardening. Niobium will also impact the size of microstructural components through its precipitation as carbo-nitrides and by retarding the recrystallization during heating process. Thus finer microstructure formed at the end of the holding temperature and as a consequence after the completion of annealing that will lead to the hardening of the Steel of the present invention. However, Niobium content above 0.1% is not economically interesting as a saturation effect of its influence is observed this means that additional amount of Niobium does not result in any strength improvement of the product.

Titanium is an optional element and may be added to the Steel of the present invention between 0.001% and 0.1%. As Niobium, it is involved in carbo-nitrides formation so plays a role in hardening of the Steel of the present invention. In addition Titanium also forms Titanium-nitrides which appear during solidification of the cast product. The amount of Titanium is so limited to 0.1% to avoid formation of coarse Titanium-nitrides detrimental for formability. In case the Titanium content is below 0.001% it does not impart any effect on the steel of the present invention.

Calcium content in the steel of the present invention is between 0.0001% and 0.005%. Calcium is added to steel of the present invention as an optional element especially during the inclusion treatment. Calcium contributes towards the refining of Steel by arresting the detrimental Sulfur content in globular form, thereby, retarding the harmful effects of Sulfur.

Copper may be added as an optional element in an amount of 0.01% to 2% to increase the strength of the steel and to improve its corrosion resistance. A minimum of 0.01% of Copper is required to get such effect. However, when its content is above 2%, it can degrade the surface aspects.

Molybdenum is an optional element that constitutes 0.001% to 0.5% of the Steel of the present invention; Molybdenum plays an effective role in determining hardenability and hardness, delays the appearance of Bainite and avoids carbides precipitation in Bainite. However, the addition of Molybdenum excessively increases the cost of the addition of alloy elements, so that for economic reasons its content is limited to 0.5%.

Vanadium is effective in enhancing the strength of steel by forming carbides or carbo-nitrides and the upper limit is 0.1% due to the economic reasons. Other elements such as Cerium, Boron, Magnesium or Zirconium can be added individually or in combination in the following proportions by weight: Cerium≤0.1%, Boron≤0.003%, Magnesium≤0.010% and Zirconium≤0.010%. Up to the maximum content levels indicated, these elements make it possible to refine the grain during solidification. The remainder of the composition of the Steel consists of iron and inevitable impurities resulting from processing.

The microstructure of the Steel sheet comprises:

Ferrite constitutes from 50% to 80% of microstructure by area fraction for the Steel of the present invention. Ferrite constitutes the primary phase of the steel as a matrix. In the present invention, Ferrite cumulatively comprises of Polygonal ferrite and acicular ferrite. Ferrite imparts high strength as well as elongation to the steel of the present invention. To ensure an elongation of 26% and preferably 28% or more it is necessary to have 50% of Ferrite. Ferrite is formed during the cooling after annealing in steel of the present invention. But whenever ferrite content is present above 80% in steel of the present invention the strength is not achieved.

Bainite constitutes from 10% to 30% of microstructure by area fraction for the Steel of the present invention. In the present invention, Bainite cumulatively consists of Lath Bainite and Granular Bainite. To ensure tensile strength of 630 MPa and preferably 650 MPa or more it is necessary to have 10% of Bainite. Bainite is formed during over-aging holding.

Residual Austenite constitutes from 1% to 10% by area fraction of the Steel. Residual Austenite is known to have a higher solubility of Carbon than Bainite and, hence, acts as effective Carbon trap, therefore, retarding the formation of carbides in Bainite. Carbon percentage inside the Residual Austenite of the present invention is preferably higher than 0.9% and preferably lower than 1.1%. Residual Austenite of the Steel according to the invention imparts an enhanced ductility.

Martensite constitutes between 1% and 5% of microstructure by area fraction and found in traces. Martensite for present invention includes both fresh martensite and tempered martensite. Present invention form martensite due to the cooling after annealing and get tempered during over-aging holding. Fresh Martensite also form during cooling after the coating of cold rolled steel sheet. Martensite imparts ductility and strength to the Steel of the present invention when it is below 5%. When Martensite is in excess of 5% it imparts excess strength but diminishes the elongation beyond acceptable limit.

In addition to the above-mentioned microstructure, the microstructure of the cold rolled and heat treated steel sheet is free from microstructural components, such as pearlite and cementite without impairing the mechanical properties of the steel sheets.

A steel sheet according to the invention can be produced by any suitable method. A preferred method consists in providing a semi-finished casting of steel with a chemical composition according to the invention. The casting can be done either into ingots or continuously in form of thin slabs or thin strips, i.e. with a thickness ranging from approximately 220 mm for slabs up to several tens of millimeters for thin strip.

For example, a slab having the above-described chemical composition is manufactured by continuous casting wherein the slab optionally underwent the direct soft reduction during the continuous casting process to avoid central segregation and to ensure a ratio of local Carbon to nominal Carbon kept below 1.10. The slab provided by continuous casting process can be used directly at a high temperature after the continuous casting or may be first cooled to room temperature and then reheated for hot rolling.

The temperature of the slab, which is subjected to hot rolling, is preferably at least 1150° C. and must be below 1280° C. In case the temperature of the slab is lower than 1150° C., excessive load is imposed on a rolling mill and, further, the temperature of the steel may decrease to a Ferrite transformation temperature during finishing rolling, whereby the steel will be rolled in a state in which transformed Ferrite contained in the structure. Therefore, the temperature of the slab is preferably sufficiently high so that hot rolling can be completed in the temperature range of Ac3 to Ac3+100° C. and final rolling temperature remains above Ac3. Reheating at temperatures above 1280° C. must be avoided because they are industrially expensive.

A final rolling temperature range between Ac3 to Ac3+100° C. is preferred to have a structure that is favorable to recrystallization and rolling. It is necessary to have final rolling pass to be performed at a temperature greater than Ac3, because below this temperature the steel sheet exhibits a significant drop in rollability. The sheet obtained in this manner is then cooled at a cooling rate above 30° C./s to the coiling temperature which must be below 570° C. Preferably, the cooling rate will be less than or equal to 200° C./s.

The hot rolled steel sheet is then coiled at a coiling temperature below 570° C. to avoid ovalization and preferably below 550° C. to avoid scale formation. The preferred range for such coiling temperature is between 350° C. and 550° C. The coiled hot rolled steel sheet may be cooled down to room temperature before subjecting it to optional hot band annealing.

The hot rolled steel sheet may be subjected to an optional scale removal step to remove the scale formed during the hot rolling before optional hot band annealing. The hot rolled sheet may then subjected to an optional Hot Band Annealing at temperatures between 400° C. and 750° C. for at least 12 hours and not more than 96 hours, the temperature remaining below 750° C. to avoid transforming partially the hot-rolled microstructure and, therefore, losing the microstructure homogeneity. Thereafter, an optional scale removal step of this hot rolled steel sheet may performed through, for example, pickling of such sheet. This hot rolled steel sheet is subjected to cold rolling to obtain a cold rolled steel sheet with a thickness reduction between 35 to 90%. The cold rolled steel sheet obtained from cold rolling process is then subjected to annealing to impart the steel of the present invention with microstructure and mechanical properties.

In the annealing, the cold rolled steel sheet subjected to two steps of heating to reach the soaking temperature between Ac1+30° C. and Ac3 wherein Ac1 and Ac3 for the present steel is calculated by using the following formula:

$$Ac1=723-10,7[Mn]-16[Ni]+29,1[Si]+16,9[Cr]+6,38[W]+290[As]$$

$$Ac3=910-203[C]^{\wedge}(1/2)-15,2[Ni]+44,7[Si]+104[V]+31,5[Mo]+13,1[W]-30[Mn]-11[Cr]-20[Cu]+700[P]+400[Al]+120[As]+400[Ti]$$

wherein the elements contents are expressed in weight percent.

In step one cold rolled steel sheet is heated at a heating rate between 10° C./s and 40° C./s to a temperature range between 550° C. and 650° C. Thereafter in subsequent second step of heating the cold rolled steel sheet is heated at a heating rate between 1° C./s and 5° C./s to the soaking temperature of annealing.

Then the cold rolled steel sheet is held at the soaking temperature during 10 to 500 seconds to ensure at least 30% transformation to Austenite microstructure of the strongly work-hardened initial structure. Then the cold rolled steel sheet is then cooled in two step cooling to an over-aging holding temperature. In step one of cooling the cold rolled steel sheet is cooled at cooling rate less than 5° C./s to a temperature range between 600° C. and 720° C. During this step one of cooling ferrite matrix of the present invention is formed. Thereafter in a subsequent second cooling step the cold rolled steel sheet is cooled to an overaging temperature range between 250° C. and 470° C. at a cooling rate between 10° C./s and 100° C./s. Then hold the cold rolled steel sheet in the over-aging temperature range during 5 to 500 seconds. Then bring the cold rolled steel sheet to the temperature to a coating bath temperature range of 420° C. and 480° C. to facilitate coating of the cold rolled steel sheet. Then the cold rolled steel sheet is coated by any of the known industrial processes such as Electro-galvanization, JVD, PVD, Hot dip (GI/GA) etc.

EXAMPLES

The following tests, examples, figurative exemplification and tables which are presented herein are non-restricting in nature and must be considered for purposes of illustration only, and will display the advantageous features of the present invention.

Steel sheets made of steels with different compositions are gathered in Table 1, where the steel sheets are produced according to process parameters as stipulated in Table 2, respectively. Thereafter Table 3 gathers the microstructures of the steel sheets obtained during the trials and table 4 gathers the result of evaluations of obtained properties.

TABLE 1

| Sample Steels | C | Mn | Si | P | S | Al | N | Other elements present |
|---|---|---|---|---|---|---|---|---|
| I1 | 0.148 | 1.54 | 0.707 | 0.014 | 0.0027 | 0 | 0.0045 | — |
| I2 | 0.148 | 1.54 | 0.707 | 0.014 | 0.0027 | 0 | 0.0045 | — |
| I3 | 0.148 | 1.54 | 0.707 | 0.014 | 0.0027 | 0 | 0.0045 | — |
| I4 | 0.131 | 1.47 | 0.677 | 0.014 | 0.0022 | 0.003 | 0.0053 | — |
| R1 | 0.148 | 1.52 | 0.698 | 0.013 | 0.0027 | 0 | 0.0044 | — |
| R2 | 0.148 | 1.52 | 0.698 | 0.013 | 0.0027 | 0 | 0.0044 | — |
| R3 | 0.148 | 1.52 | 0.698 | 0.013 | 0.0027 | 0 | 0.0044 | — |
| R4 | 0.114 | 1.62 | 0.293 | 0.027 | 0.0028 | 0.031 | 0.005 | Ni 0.025, Cr 0.345 |

I = according to the invention; R = reference; underlined values: not according to the invention.

Table 2

Table 2 gathers the annealing process parameters implemented on steels of Table 1. The Steel compositions 11 to 14 serve for the manufacture of sheets according to the invention. This table also specifies the reference steel which are designated in table from R1 to R4. Table 2 also shows tabulation of Ac1 and Ac3. These Ac1 and Ac3 are defined for the inventive steels and reference steels as follows:

$$Ac1=723-10,7[Mn]-16[Ni]+29,1[Si]+16,9[Cr]+6,38[W]+290[As]$$

$$Ac3==910-203[C]^{\wedge}(1/2)-15,2[Ni]+44,7[Si]+104[V]+31,5[Mo]+13,1[W]-30[Mn]-11[Cr]-20[Cu]+700[P]+400[Al]+120[As]+400[Ti]$$

wherein the elements contents are expressed in weight percent.

All sheets were cooled at a cooling rate of 34° C./s after hot rolling and were finally brought at a temperature of 460° C. before coating.

The table 2 is as follows:

TABLE 2

| Steel Sample | Reheating T (° C.) | HR Finish T (° C.) | HR Coiling T (° C.) | CR reduction (%) | Heating rate for fast heating before annealing (° C./s) | Fast heating stop temp. | Slow Heating Rate before annealing | soaking of annealing Temperature | Soaking time for annealing | Slow cooling rate after annealing |
|---|---|---|---|---|---|---|---|---|---|---|
| I1 | 1200 | 860 | 520 | 65 | 10 | 600 | 1.2 | 770 | 238 | 0.5 |
| I2 | 1200 | 860 | 520 | 65 | 22 | 600 | 2.6 | 770 | 110 | 1 |
| I3 | 1200 | 860 | 520 | 65 | 22 | 600 | 2.6 | 770 | 110 | 1 |
| I4 | 1200 | 850 | 500 | 65 | 22 | 600 | 2.6 | 770 | 110 | 1 |
| R1 | 1200 | 850 | 500 | 65 | 14 | 600 | 1.3 | 740 | 179 | 0.4 |
| R2 | 1200 | 850 | 500 | 65 | 16 | 700 | 1.6 | 770 | 179 | 1.1 |
| R3 | 1200 | 850 | 500 | 65 | 14 | 600 | 1.6 | 770 | 293 | 30 |
| R4 | 1200 | 920 | 585 | 65 | 10 | 600 | 1.2 | 770 | 238 | 0.5 |

| Steel Sample | Slow cooling stop temperature (° C./s) | Fast cooling rate (° C./s) | Fast cooling stop temperature (° C.) | temperature for holding (° C.) | Holding temperature (s) | Ac3 (° C.) | Ac1 (° C.) |
|---|---|---|---|---|---|---|---|
| I1 | 700 | 23 | 350 | 350 | 143 | 827 | 727 |
| I2 | 700 | 50 | 400 | 400 | 66 | 827 | 727 |
| I3 | 700 | 75 | 250 | 250 | 66 | 827 | 727 |
| I4 | 700 | 58 | 350 | 350 | 66 | 834 | 727 |
| R1 | 700 | 31 | 400 | 400 | 107 | 827 | 727 |
| R2 | 650 | 26 | 400 | 400 | 107 | 827 | 727 |
| R3 | — | 30 | 475 | 475 | 107 | 827 | 727 |
| R4 | 700 | 27 | 350 | 350 | 143 | 835 | 720 |

I = according to the invention; R = reference; underlined values: not according to the invention.

Table 3

Table 3 exemplifies the results of the tests conducted in accordance with the standards on different microscopes such as Scanning Electron Microscope for determining the microstructures of both the inventive and reference steels.

The results are stipulated herein:

| Sample Steels | Ferrite (%) | Bainite (%) | Residual Austenite (%) | Martensite (%) | Ferrite + Bainite (%) |
|---|---|---|---|---|---|
| I1 | 59 | 30 | 7 | 4 | 89 |
| I2 | 63 | 29 | 6 | 2 | 92 |
| I3 | 60 | 28 | 7 | 5 | 88 |
| I4 | 73 | 18 | 8 | 1 | 91 |
| R1 | 72 | 23 | 5 | 0 | 95 |
| R2 | 63 | 30 | 7 | 0 | 93 |
| R3 | 60 | 37 | 3 | 0 | 97 |
| R4 | 62 | 33 | 5 | 0 | 95 |

I = according to the invention; R = reference; underlined values: not according to the invention.

Table 4

Table 4 exemplifies the mechanical properties of both the inventive steel and reference steels. In order to determine the tensile strength, yield strength and total elongation, tensile tests are conducted in accordance of JIS Z2241 standards.

The results of the various mechanical tests conducted in accordance to the standards are gathered

TABLE 4

| Sample Steels | Tensile Strength (MPa) | YS (MPa) | YS/TS | Total Elongation (%) |
|---|---|---|---|---|
| I1 | 650 | 349 | 0.54 | 30.1 |
| I2 | 661 | 341 | 0.52 | 29.3 |
| I3 | 691 | 325 | 0.47 | 26.4 |
| I4 | 640 | 329 | 0.51 | 29.8 |
| R1 | 595 | 340 | 0.57 | 25.3 |
| R2 | 619 | 359 | 0.58 | 24.4 |

TABLE 4-continued

| Sample Steels | Tensile Strength (MPa) | YS (MPa) | YS/TS | Total Elongation (%) |
|---|---|---|---|---|
| R3 | 603 | 372 | 0.62 | 23.8 |
| R4 | 622 | 343 | 0.55 | 22.5 |

I = according to the invention; R = reference; underlined values: not according to the invention.

What is claimed is:

1. A cold rolled and heat treated steel sheet having a composition comprising the following elements, expressed in percentage by weight:

0.11%≤Carbon≤0.15%

1.1%≤Manganese≤1.8%

0.5%≤Silicon≤0.9%

0.002%≤Phosphorus≤0.02%

0%≤Sulfur≤0.003%

0%≤Aluminum≤0.05%

0%≤Nitrogen≤0.007% and optionally at least one of the following elements:

0.05%≤Chromium≤1%

0.001%≤Molybdenum≤0.5%

0.001%≤Niobium≤0.1%

0.001%≤Titanium≤0.1%

0.01%≤Copper≤2%

0.01%≤Nickel≤3%

0.0001%≤Calcium≤0.005%

0%≤Vanadium≤0.1%

0%≤Boron≤0.003%

0%≤Cerium≤0.1%

0%≤Magnesium≤0.010%

0%≤Zirconium≤0.010%, a remainder of the composition being composed of iron and unavoidable impurities caused by processing, a microstructure of the steel sheet comprising in area fraction, 50 to 80% Ferrite, 10 to 30% Bainite, 1 to 10% Residual Austenite, and 1% to 5% Martensite, wherein cumulated amounts of the Bainite and the Ferrite are less than 94%, wherein the steel sheet has an ultimate tensile strength of 630 MPa or more, and a total elongation of 26% or more, wherein the bainite consists of lath bainite and granular bainite.

2. The cold rolled heat treated steel sheet as recited in claim 1 wherein the composition includes 0.6% to 0.8% of Silicon.

3. The cold rolled heat treated steel sheet as recited in claim 1 wherein the composition includes 0.12% to 0.15% of Carbon.

4. The cold rolled heat treated steel sheet as recited in claim 1 wherein the composition includes 0% to 0.04% of Aluminum.

5. The cold rolled heat treated steel sheet as recited in claim 1 wherein the composition includes 1.2% to 1.8% of Manganese.

6. The cold rolled heat treated steel sheet as recited in claim 1 wherein the composition includes 1.3% to 1.7% of Manganese.

7. The cold rolled heat treated steel sheet as recited in claim 1 wherein the cumulated amounts of the Ferrite and the Bainite are more than or equal to 65% and less than 94%; and wherein the percentage of the Bainite is higher than 15% and less than or equal to 30%.

8. The cold rolled heat treated steel sheet as recited in claim 1 wherein a carbon content of the Residual Austenite is between 0.9 to 1.1%.

9. The cold rolled heat treated steel sheet as recited in claim 1 wherein the ultimate tensile strength is 640 MPa or more and the total elongation greater than or equal to 28%.

10. A method of production of the cold rolled heat treated steel sheet as recited in claim 1 comprising the following successive steps:

providing a semi-finished product with the composition;

reheating the semi-finished product to a temperature between 1150° C. and 1280° C.;

rolling the semi-finished product in an austenitic range wherein the hot rolling finishing temperature is above Ac3 to obtain a hot rolled steel sheet;

cooling the hot rolled steel sheet at a cooling rate above 30° C./s to a coiling temperature below 570° C. and coiling the hot rolled steel sheet;

cooling the hot rolled steel sheet to room temperature;

optionally performing a scale removal process on the hot rolled steel sheet;

optionally annealing the hot rolled steel sheet at temperature between 400° C. and 750° C.;

optionally performing a further scale removal process on the hot rolled steel sheet;

cold rolling the hot rolled steel sheet with a reduction rate between 35 and 90% to obtain a cold rolled steel sheet;

annealing the cold rolled steel sheet at a soaking temperature between Ac1+30° C. and Ac3 for a duration between 10 and 500 seconds by heating the cold rolled steel sheet in a two step heating with a step one and a step two; in step one, the cold rolled steel sheet being heated at a heating rate between 10° C./s and 40° C./s to a temperature range between 550° C. and 650° C.; in step two, the cold rolled steel sheet being heated at a heating rate between 1° C./s and 5° C./s from a temperature range between 550° C. and 650° C. to the soaking temperature;

cooling the cold rolled steel sheet in a two step cooling, wherein in a first cooling step, the cold rolled steel sheet is cooled at a cooling rate less 5° C./s to temperature range between 600° C. and 720° C.; and thereafter, in a second cooling step, from a temperature range between 600° C. and 720° C. to an overaging temperature at a cooling rate between 10° C./s to 100° C./s;

overaging the cold rolled steel sheet at a temperature range between 250° C. and 470° C. during 5 to 500 seconds and bringing the cold rolled steel sheet to a temperature range between 420° C. and 480° C. to facilitate coating; and then coating the cold rolled heat treated steel sheet to obtain the cold rolled heat treated steel sheet, the cold rolled heat treated steel sheet having the microstructure.

11. The method as recited in claim 10 wherein the coiling temperature is below 550° C.

12. The method as recited in claim 10 wherein the finishing rolling temperature is between Ac3 and Ac3+100° C.

13. The method as recited in claim 10 wherein the cooling rate after annealing is less than 3° C./s in a temperature range between 600° C. and 700° C.

14. The method as recited in claim 10 wherein the cold rolled steel sheet is annealed between Ac1+30° C. and Ac3 and a temperature of annealing is selected so as to ensure a presence of at least 30% of austenite during annealing.

15. A method for manufacturing of structural or safety parts of a vehicle comprising the steps of a method as recited in claim 10.

16. The cold rolled heat treated steel sheet as recited in claim 1 wherein the microstructure of the steel sheet consists of, in area fraction, 50 to 80% Ferrite, 10 to 30% Bainite, 1 to 10% Residual Austenite, and 1% to 5% Martensite, wherein cumulated amounts of the Bainite and the Ferrite are less than 94%, and wherein the steel sheet has an ultimate tensile strength of 630 MPa or more, and a total elongation of 26% or more.

* * * * *